United States Patent [19]

Nakamura et al.

[11] Patent Number: 4,678,590

[45] Date of Patent: Jul. 7, 1987

[54] SOFTENER COMPOSITION

[75] Inventors: Kazuhito Nakamura; Hisami Sasaki, both of Yokohama; Masayoshi Chigira, Tokyo; Kenji Yokoi, Chiba, all of Japan

[73] Assignee: Lion Corporation, Tokyo, Japan

[21] Appl. No.: 790,958

[22] Filed: Oct. 24, 1985

[30] Foreign Application Priority Data

Oct. 25, 1984 [JP] Japan ..... 59-224792

[51] Int. Cl.[4] ..... D06M 13/46

[52] U.S. Cl. ..... 252/8.8; 252/8.75

[58] Field of Search ..... 252/8.75, 8.8

[56] References Cited

U.S. PATENT DOCUMENTS

| | | | |
|---|---|---|---|
| 3,920,565 | 11/1975 | Morton | 252/8.8 |
| 3,974,076 | 8/1976 | Wiersema et al. | 252/8.8 |
| 4,214,998 | 7/1980 | Joy | 252/8.8 |
| 4,237,016 | 12/1980 | Rudkin et al. | 252/8.8 |
| 4,439,335 | 3/1984 | Burns | 252/8.8 |
| 4,442,013 | 4/1984 | Fraikin et al. | 252/8.8 |
| 4,447,343 | 5/1984 | May et al. | 252/8.8 |

*Primary Examiner*—Paul Lieberman
*Assistant Examiner*—Willie J. Thompson
*Attorney, Agent, or Firm*—Burns, Doane, Swecker & Mathis

[57] ABSTRACT

This invention provides a highly concentrated aqueous softener composition which has improved viscosity characteristics and an excellent long-term storability. The softener composition comprises 7 to 50% by weight of cationic softening agent, 0.05 to 10% by weight of alkylene oxide adducted nonionic surfactant having at least one unsaturated bond in its molecule, 0.005 to 5% by weight of inorganic electrolyte, and the balance of water.

17 Claims, No Drawings

SOFTENER COMPOSITION

BACKGROUND OF THE INVENTION (1) Field of the Invention

This invention relates to a softener composition able to soften many kinds of clothes, fabrics, textiles, hair and the like, and in particular to a highly concentrated softener composition having improved viscosity characteristics.

(2) Description of the Prior Art

Many studies have recently been conducted on softener compositions containing large amounts of softening agent, the so-called highly concentrated-type softeners, intended to replace conventional aqueous softeners which contain only about 4% by weight of cationic softening agent. The main object of these studies has been to reduce the cost of transporting the softener, but many difficulties have been met in the development of highly concentrated-type softeners because the behavior of an aqueous solution containing a cationic softening agent is complicated. In particular, where the softener is in the form of an aqueous solution containing a dispersion of insoluble or slightly soluble cationic agent, a sudden rise of viscosity thereof and water separation therefrom occurs when the content of the cationic agent is made too high, other components are added thereto, or the temperature thereof is changed.

Many methods have been proposed to solve these problems. Among these are, for example, a method (Japanese Patent Pre-examined Publication (KOKAI) No. 51877/1980) in which cationized polyoxyethylene alkylamine and lower alcohol are added to a mixture of quaternary ammonium salt and imidazolinium salt and a method (Japanese Patent Pre-examined Publication (KOKAI) No. 149378/1983) in which an aliphatic amine polyglycol, a lower alcohol and an acid are added to a quaternary ammonium salt.

These methods, however, are insufficient regarding the prevention of a rise in the viscosity of the softener composition and separation of water therefrom by a temperature change where the composition contains cationic softening agent at high concentrations.

SUMMARY OF THE INVENTION

Under such circumstances, this invention was accomplished on the basis of the discovery that the aforesaid problems of softeners containing a cationic softening agent at high concentrations can be effectively solved by combining a polyalkylene oxide adducted nonionic surfactant having an ethylene unsaturated bond with an inorganic electrolyte.

It is, therefore, a primary object of the present invention to provide a softener composition containing cationic softening agent at high concentration whose viscosity is little changed by temperature change.

Another object of this invention is to provide a softener composition from which water does not separate even after long-term storage.

These and other objects of this invention will be clear from the following description.

In accordance with the present invention, there is provided a softener composition which comprises (A) 7 to 50% by weight of cationic softening agent; (B) 0.05 to 10% by weight of alkylene oxide-adducted nonionic surfactant having at least one unsaturated bond in its molecule; (c) 0.005 to 5% by weight of inorganc electrolyte; and (D) an aqueous vehicle.

DESCRIPTION OF THE PREFERRED EMBODIMENTS

In the softener composition of the present invention, any compound able to soften fabric and hair human, including many kinds of amine salts, quaternary ammonium salts and the like, may be used as component (A). There is generally used an insoluble or slightly soluble quaternary ammonium salt-type cationic surfactant, for example, a quaternary ammonium salt including at least two alkyl groups or alkenyl groups having 8 to 26 carbon atoms in their molecules. Among these it is preferable to use a quaternary ammonium salt including two alkyl groups or alkenyl groups having 10 to 24 carbon atoms in their molecules, for example ammonium salts, amido ammonium salts and imidazolinium salts represented by the following formula (I) and (II):

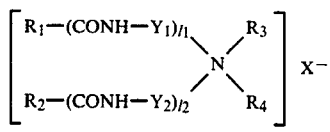

(I)

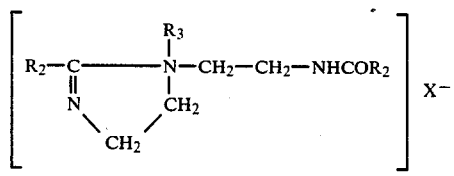

(II)

wherein $R_1$ and $R_2$ are selected from alkyl, hydroxyalkyl and alkenyl having 10 to 24 carbon atoms;

$R_3$ and $R_4$ are selected from alkyl and hydroxyalkyl having 1 to 3 carbon atoms, benzyl and $-(C_2H_4O)_{lH}$ ($l_3$ being 1 to 5);

$Y_1$ and $Y_2$ are ethylene or propylene;

$l_1$ and $l_2$ are the numbers 0 or 1; and X is halogen or a monoalkyl sulfuric acid residue.

Examples of these quaternary ammonium salts include dilauryl dimethyl ammonium chloride, dipalmityl methyl hydroxyethyl ammonium methylsulfate, dihydrogenated tallowalkyl dimethyl ammonium chloride, distearyl methyl polyoxyethylene (average polymerization degree: 5 mole) ammonium chloride, dihydrogenated tallow-alkyl ethyl benzyl ammonium chloride, ditetradecyl dimethyl ammonium chloride, di[(2-dodecanoylamido)ethyl]dimethyl ammonium chloride, di[2-octadecanoylamido)ethyl]dimethyl ammonium methosulfate, ethyl-1-octadecanoyl amido ethyl-2-heptadecyl imidazolinium ethosulfate, methyl-1-tallow amido ethyl-2-tallow alkyl imidazolinium methylsulfate, methyl-1-oleylamido ethyl-2-oleyl imidazolinium methosulfate and the like, and mixtures thereof.

The softener composition of the present invention contains 7 to 50%, preferably 8 to 30%, by weight of component (A). In the aqueous softener composition, it is desirable to disperse insoluble or slightly soluble quaternary ammonium salts as fine particles with an average diameter of no greater than 10μ, preferably no greater than 5μ, by well-known dispersing means.

In the softener composition of the present invention, any nonionic surfactant prepared by addition of polyalkylene oxide and having at least one unsaturated bond in its molecule may be used as component (B). Examples of such nonionic surfactants include adducts of alkylene oxide with unsaturated fatty alcohols, unsaturated fatty acids, unsaturated fatty amidos, unsaturated fatty amines and the like. As for alkylene oxide, there is generally used ethylene oxide, propylene oxide, a mixture of ethylene oxide and propylene oxide or butylene oxide. Among these, it is preferable to use ethylene oxide. The average number of moles of addition of alkylene oxide is 20 to 80 moles, preferably 30 to 60 moles. More concretely, examples of component (B) include one compound or mixture selected from adducts of 20 to 80 moles of alkylene oxide with unsaturated alcohols or amines having 12 to 22, preferably 14 to 18 carbon atoms. In preparing the above nonionic surfactants, unsaturated alcohols and amines derived from unsaturated fatty acids having 12 to 22 carbon atoms are generally usable.

In the softener composition of the present invention, nonionic surfactants derived from saturated fatty alcohols and amines having 12 to 22 carbon atoms can be used together with the above nonionic surfactant having unsaturated bond insofar as the iodine value of the mixture of these nonionic surfactants in no less than 1, preferably 2 to 25. In this case, it is advantageous to use a nonionic surfactant prepared from alcohols and amines derived from tallow acid (i.e., it contains saturated and unsaturated fatty acids) because in this case the process of mixing saturated and unsaturated nonionic surfactants can be omitted.

The softener composition of the present invention contains 0.5 to 10%, preferably 0.5 to 6% by weight of component (B).

In the softener composition of the present invention, any inorganic electrolyte able to dissociate in an aqueous vehicle may be used as component (C).

Examples of component (C) include sodium chloride, potassium chloride, magnesium chloride, aluminum chloride, sodium sulfate, ammonium sulfate, potassium sulfate and the like. Among these, sodium chloride is particularly preferable.

The softener composition of the present invention contains 0.005 to 5%, preferably 0.1 to 3% by weight of component (C).

The softener composition of the present invention is required to contain said three components, and desirably contains these components at a specific ratio in which the ratio of A to B is 150/1 to 3/1, preferably 20/1 to 5/1 (by weight) and the ratio of A to C is 1000/1 to 10/1, preferably 100/1 to 15/1. In addition to these components, the balance of the softener composition of the present invention is an aqueous vehicle.

In order to inhibit a rise in the viscosity of the aqueous softener composition when it thaws after freezing, it is desirable to add 1 to 50%, preferably 3 to 20%, by weight of a polyol such as ethylene glycol, prophylene glycol, glycerine or hexylene glycol to the composition.

In general, lower aliphatic alcohols, for example, ethanol and isopropanol are also added to the liquid softener composition. This is because component (A) is usually prepared in the form of a paste having a concentration of 70 to 90% by weight and containing lower alcohol as a diluent. However, since it is not preferable that the softener composition substantially contain lower aliphatic alcohol, the amount of these alcohols contained in the softener composition should not exceed about 5% by weight, preferably about 3% by weight. Accordingly, where component (A) contains the lower alcohol in such amount that end products of the present invention contain more than about 5% by weight of the alcohol, excess amount of or all of the alcohol should be removed therefrom, before using the component (A) for preparing the composition of the present invention, by for example, vaporization with heating. The lower alcohols also have a tendency to make the viscosity of the end product rise during storage (in particular, at high temperature). Furthermore, where the alcohol is isopropyl alcohol, the smell of the end product is not preferable. If desired, urea, pH controlling agents, silicones, hydrocarbons, cellulose derivatives, germicides, pigments, dyes, perfumes, antioxidants, UV absorbers, fluoresent whitening agents and the like can be added to the softener composition. PH of the softener composition is not limited, but it is desirable that pH of the composition be between 5.5 and 9.0.

Since the viscosity change of the softener composition according to the present invention is slight in spite of its containing a significant amount of cationic softening agent, it is easy to charge the composition into plastic bottles and to discharge the composition from the bottles when the softener composition is used, and as a result, the softener composition can be easily handled. In addition, as water does not separate from the softener composition, the usefulness of the softener compostion is greatly entranced.

The present invention will now be further illustrated by examples.

The process for preparing the softener composition and the methods of measurement of viscosity change thereof and the water separation therefrom used in the Examples were as shown below.

PROCESS FOR PREPARING AQUEOUS DISPERSION

Components except for component (A) were dissolved in water, after which the resulting solution was heated to 45° C. A molten mixture consisting of component (A), a small amount of lower alcohol and water was dropped into and intimately dispersed in the solution by agitating, and thereafter the resulting dispersion was cooled to 25° C. As a result, the aqueous dispersion was obtained.

METHOD OF MEASUREMENT OF VISCOSITY CHANGE

The viscosity of the softener composition (the aqueous dispersion) was measured by a B-type viscometer (manufactured to TOKYO KEIKI Co. Ltd.,) after it was preserved under a given temperature for one month.

METHOD OF MEASUREMENT OF WATER SEPARATION

The sample (the aqueous dispersion) was charged in a transparent cylindrical bottle having an inner diameter of 45 mm to 7 cm from the bottom of the bottle. The bottle was left at rest under given conditions for one month and the thickness of the separated water layer was then measured in line with the following standard.

O: no separation

Δ: less than 3 mm

X: 3 mm or more

EXAMPLE 1

Aqueous softener compositions consisting of 13% by weight of di-hydrogenated tallow alkyl dimethyl ammonium chloride (component (A)), 1% by weight of component (B), 0.4% by weight of sodium chloride (component (C)), 10% by weight of ethylene glycol and the remainder of water were prepared and their storability was measured. The above softener compositions also contained 1.7% by weight of isopropyl alcohol which was brought in by component (A).

The results obtained were as shown in Table I. In the table, POE and $\bar{p}$ mean the polyoxyethylene and average molecular number of ethylene oxide adducted, respectively. The iodine value of component (B) is shown in brackets.

EXAMPLE 2

The amounts of the respective components were changed and softener compositions were prepared. The results obtained upon measurement of the characteristics thereof are shown in Table 2. In the table, the symbols i-ProH and EtoH mean contained amount(%) of isopropyl alcohol and ethanol, respectively.

The viscosities of these composition were all in the range of 80 to 200 c.p. just after preparations and were less than 1500 c.p. after one-month storage, and no phenomena such as water separation are observed.

TABLE 1

| | Component (B) | viscosity just after preparation | Viscosity (CP) freezing*2 | 5° C. | 25° C. | 45° C. | Water separation 5° C. | 25° C. | 45° C. |
|---|---|---|---|---|---|---|---|---|---|
| Present invention Unsat. | POE ($\bar{p}$ = 50) oleyl ether (9.8)*1 | 110 | 330 | 150 | 180 | 550 | o | o | o |
| | POE ($\bar{p}$ = 30) oleyl ether (15.2) | 130 | 620 | 380 | 230 | 390 | o | o | o |
| | adduct of POE ($\bar{p}$ = 50) (5.4) to tallow alcohol | 120 | 570 | 310 | 220 | 710 | o | o | o |
| | POE ($\bar{p}$ = 50) Tallow alkyl amine (4.1) | 100 | 420 | 170 | 280 | 500 | o | o | o |
| | POE ($\bar{p}$ = 30) Tallow alkyl amine (6.4) | 110 | 810 | 510 | 350 | 330 | o | o | o |
| | POE ($\bar{p}$ = 60) Oleyl amine (7.8) | 110 | 340 | 140 | 180 | 750 | o | o | o |
| | POE ($\bar{p}$ = 50) Oleyl amine (9.2) | 120 | 310 | 160 | 250 | 720 | o | o | o |
| Comparative example Saturated | POE ($\bar{p}$ = 50) Lauryl ether (0.1) | 170 | 10000 | 6000 | 200 | 5000 | o | x | o |
| | POE ($\bar{p}$ = 50) Stearyl ether (0.2) | 130 | 10000 | 10000 | 250 | 510 | o | o | o |
| | POE ($\bar{p}$ = 50) Stearate (0.1) | 150 | 10000 | 10000 | 4000 | 450 | o | o | o |
| | POE ($\bar{p}$ = 50) Nonyl phenyl ether (0.1) | 130 | 580 | 580 | 240 | 6000 | o | o | o |
| | POE ($\bar{p}$ = 50) Hydrogenated alkyl amine (0.3) | 110 | 10000 | 10000 | 270 | 520 | o | o | o |
| | POE ($\bar{p}$ = 50) Hydrogenated alkyl amido (0.3) | 520 | 10000 | 10000 | 6000 | 1700 | o | o | o |

*1iodine value slown in brackets ( )

*2Three cycles of freezing (−15° C., 40 Hr) and melting (25° C., 8 Hr) were repeated.

For a consumer product, it is desired that the viscosity of the softener composition generally be lower than about 1500 c.p. As is obvious from table 1, the long term storability of the softener compositions according to the present invention is excellent, i.e. the viscosity thereof can be maintained below 1500 c.p. at both high and low temperatures, and phenomena such as water separation do not occur.

These compositions thus showed excellent storability.

TABLE 2

| Components | | Number of composition 1 | 2 | 3 | 4 | 5 | 6 |
|---|---|---|---|---|---|---|---|
| Component (A) | Di-hydrogenated tallow alkyl dimethyl ammonium chloride | 8 | | 5 | 5 | | |
| | Dioleyl dimethyl ammonium chloride | | 15 | | 10 | | |
| | Methyl-1-tallow amido ethyl-2-tallow alkyl imidazolinium metho sulfate | | | | | 10 | |
| | Methyl-1-oleyl amido ethyl-2-oleyl imidazolinium methosulfate | | | 10 | | 10 | 20 |
| Component (B) | adduct of POE ($\bar{p}$ = 50) to tallow alcohol (5.4) | 1.0 | | 1.5 | 1.5 | 1.0 | |
| | POE ($\bar{p}$ = 50) tallow alkyl amine (4.1) | | 2.0 | | | 2.0 | 3.5 |
| Component (C) | NaCl | 0.2 | | | | | 1.2 |
| | $MgCl_2$ | | 0.4 | | | 0.8 | |
| | $Alcl_3$ | | | 0.3 | | | |
| | $Na_2SO_4$ | | | | 0.3 | | |
| Component (D) | Ethylene glycohol | 4 | 7 | 7 | 3 | 4 | 10 |
| | Diethylene glycohol | | 3 | | 7 | 3 | |
| | Propylene glycohol | | | 3 | | 3 | 5 |
| Other components | coloring agent: acid dye of red color series | 0.0003 | 0.0005 | 0.0008 | | | |
| | coloring agent: blue pigment of phthalocyanine series | | | | 0.001 | 0.001 | 0.002 |
| | perfume: floral bouquet type | 0.4 | 0.4 | | 0.6 | | |
| | perfume: fongere type | | | 0.4 | | 0.6 | 0.6 |
| | *Germicide | 0.002 | 0.004 | 0.006 | 0.005 | 0.008 | 0.008 |
| amount of lower alcohol carried from the component (A) | | i-PrOH 1.1 | i-PrOH 3.0 | i-PrOH 0.3 EtOH 1.3 | i-PrOH 2.0 | i-PrOH 1.3 EtOH 1.3 | EtOH 2.7 |
| deionized water | | Residue | Residue | Residue | Residue | Residue | Residue |
| | Total | 100 | 100 | 100 | 100 | 100 | 100 |

*2-bromo-2-nitro-1,3-propanediol

What is claimed is:

1. A softener composition having improved low temperature viscosity characteristics comprising (a) 7 to 50% by weight of cationic softening agent; (B) 0.05 to 10% by weight of alkylene oxide adducted nonionic surfactant having at least one unsaturated bond in its molecule and wherein the average number of moles of addition of alkylene oxide is 20 to 80; (c) 0.005 to 5% by weight of inorganic electrolyte; and (D) an aqueous vehicle.

2. A softener composition as set forth in claim 1 wherein the component (A) is an insoluble or slightly soluble quaternary ammonium salt-type cationic surfactant.

3. A softener composition as set forth in claim 1 wherein the component (A) is a quaternary ammonium salt including two alkyl groups or alkenyl groups having 10 to 24 carbon atoms.

4. A softener composition as set forth in claim 1 wherein the component (A) is selected from the group consisting of quaternary ammonium salts having the following formula (I) and (II):

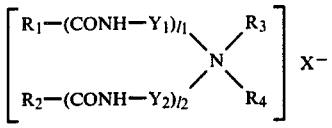

(I)

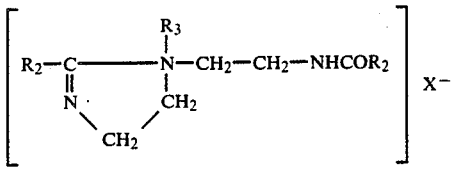

(II)

wherein $R_1$ and $R_2$ are selected from alkyl, hydroxyalkyl and alkenyl having 10 to 24 carbon atoms;

$R_3$ and $R_4$ are selected from alkyl and hydroxyalkyl having 1 to 3 carbon atoms, benzyl and $-(C_2H_4O)_{lH}$ ($l_3$ being 1 to 5);

$Y_1$ and $Y_2$ are ethylene or propylene; $l_1$ and $l_2$ are 0 or 1; and X is halogen or monoalkyl sulfuric acid residue.

5. A softener composition as set forth in claim 1 wherein the component (B) is polyoxyalkylene adducted unsaturated compound derived from a fatty alcohol, a fatty acid, a fatty amido and a fatty amine.

6. A softener composition as set forth in claim 5 wherein the average number of moles of addition of alkylene oxide is 30 to 60.

7. A softener composition as set forth in claim 5 wherein the alkylene oxide is selected from ethylene oxide, propylene oxide, mixture thereof and butylene oxide.

8. A softener composition as set forth in claim 5 wherein the unsaturated fatty alcohol and amine have 12 to 22 carbon atoms.

9. A softener composition as set forth in claim 1 wherein nonionic surfactant having no unsaturated bond in its molecule is used with component (B) in such manner that the iodine value of the mixture is 2 to 25.

10. A softener composition as set forth in claim 1 wherein the component (C) is selected from sodium chloride, potassium chloride, magnesium chloride, aluminium chloride, sodium sulfate, ammonium sulfate and potassium sulfate.

11. A softener composition as set forth in claim 1 wherein the component (D) is water.

12. A softener composition as set forth in claim 1 wherein the composition further contains 1 to 50% by weight of polyol.

13. A softener composition as set forth in claim 1 wherein the polyol is selected from ethylene glyol, propylene glycol, glycerine and hexylene glycol.

14. A softener composition as set forth in claim 1 wherein the composition contains less than 5% by weight of lower alcohol.

15. A softener composition as set forth in claim 1 wherein the ratio of the component (A) to component (B) is 150/1 to 3/1 by weight.

16. A softener composition as set forth in claim 1 wherein the ratio of component (A) to component (C) is 1000/1 to 10/1 by weight.

17. A softener composition as set forth in claim 1 wherein the amount of cationic softening agent is 8 to 30% by weight.

* * * * *